US007862042B2

(12) United States Patent
Tsai

(10) Patent No.: US 7,862,042 B2
(45) Date of Patent: Jan. 4, 2011

(54) DOLL OF FOOTBALL GAME TABLE

(76) Inventor: Jerry Tsai, No. 22, Lane 20, Zichiang Street, Taichung (TW)

( * ) Notice: Subject to any disclaimer, the term of this patent is extended or adjusted under 35 U.S.C. 154(b) by 240 days.

(21) Appl. No.: 11/968,177

(22) Filed: Jan. 1, 2008

(65) Prior Publication Data

US 2009/0170399 A1 Jul. 2, 2009

(51) Int. Cl.
*A63F 7/07* (2006.01)

(52) U.S. Cl. ..... 273/108.52; 273/108.1; 273/108.54; 446/298

(58) Field of Classification Search ..... 446/298; 273/108.1, 108.52, 108.54
See application file for complete search history.

(56) References Cited

U.S. PATENT DOCUMENTS 4,025,073 A * 5/1977 Furr et al. ..... 273/108.52
4,138,110 A * 2/1979 Hendrickson ..... 273/108.52
5,137,276 A * 8/1992 Monneret ..... 273/108.52
5,377,981 A * 1/1995 Monneret ..... 273/108.52
5,419,555 A * 5/1995 McCloud ..... 273/108.52
6,231,046 B1 * 5/2001 Tien ..... 273/108.52
6,299,163 B1 * 10/2001 Chen ..... 273/108.52
2008/0164653 A1 * 7/2008 Mercier ..... 273/108.52

OTHER PUBLICATIONS

U.S. Appl. No. 11/968,179, Jerry Tsai.

* cited by examiner

*Primary Examiner*—Gene Kim
*Assistant Examiner*—Joseph B Baldori
(74) *Attorney, Agent, or Firm*—Ming Chow; Sinorica, LLC

(57) ABSTRACT

A doll of football game table for mounting on an operation rod of the football game table. The doll includes a first main body and a second main body which are detachably latched with each other to hold the operation rod. The doll further includes at least one fixing member for engaging at least one of the main bodies with the operation rod, whereby by means of operating the operation rod, the doll can be driven to move or rotate. The doll can be directly mounted on or taken off from the operation rod. In case of damage of the doll, the main bodies of the doll can be unlatched from each other to take off the doll from the operation rod so that the doll can be easily replaced.

4 Claims, 6 Drawing Sheets

DOLL OF FOOTBALL GAME TABLE

FIELD OF THE INVENTION

The present invention is related to a game apparatus, and more particularly to a doll of a football game table detachably mounted on an operation rod of the football game table. The doll can be easily installed on or taken off from the operation rod.

BACKGROUND OF THE INVENTION

FIG. 1 shows a conventional football game table 10. Several operation rods 14 are mounted through two long sides of the table body 12. A certain number of dolls 16 are fitted on each operation rod. By means of the operation rods, the dolls 16 can be moved and rotated to drive a ball on the table body.

The conventional doll 16 is a one-piece doll having a through hole 17. When assembled, the operation rod 14 is fitted through the through hole 17 and the doll 16 is fixed on the operation rod by means of a screw 18. Such doll must be assembled with the operation rod 14 by the manufacturer before released from the factory. Once the doll is damaged, it is quite inconvenient to replace the doll. That is, it is necessary to first detach the operation rod 14 from the table body 12 and then take off the damaged doll 16 from the operation rod 14 and replace the doll with a new one. After replaced, the operation rod is reinstalled on the table body. In general, a player lacks suitable tool or component to disassemble the operation rod and replace the doll. Even if the player is able to disassemble the operation rod, it is quite troublesome and time-consuming for the player to replace the doll.

In addition, the screw 18 for fixing the doll is exposed to outer side of the doll. This affects the appearance of the entire game table.

SUMMARY OF THE INVENTION

It is therefore a primary object of the present invention to provide a doll of football game table which can be easily installed and disassembled.

It is a further object of the present invention to provide the above doll of football game table which has a tidy appearance.

The doll of football game table of the present invention includes a first main body, a second main body and at least one fixing member. The two main bodies are detachably latched with each other so that the bodies can be detachably mounted on an operation rod. The fixing member serves to engage at least one of the main bodies with the operation rod. Accordingly, the doll can be easily mounted on the operation rod, and the main bodies of the doll can be directly unlatched from each other to take off the doll from the operation rod. Therefore, when installing or disassembling the doll, it is unnecessary to disassemble the operation rod from the football game table.

Preferably, the fixing member is hidden in the doll without being exposed to outer side so that the doll has a beautiful tidy appearance.

Preferably, the front face of the first main body is recessed to form a space. The second main body is accommodated in the space and latched with the first main body.

The present invention can be best understood through the following description and accompanying drawings wherein:

DETAILED DESCRIPTION OF THE PREFERRED EMBODIMENTS

Figure 1:
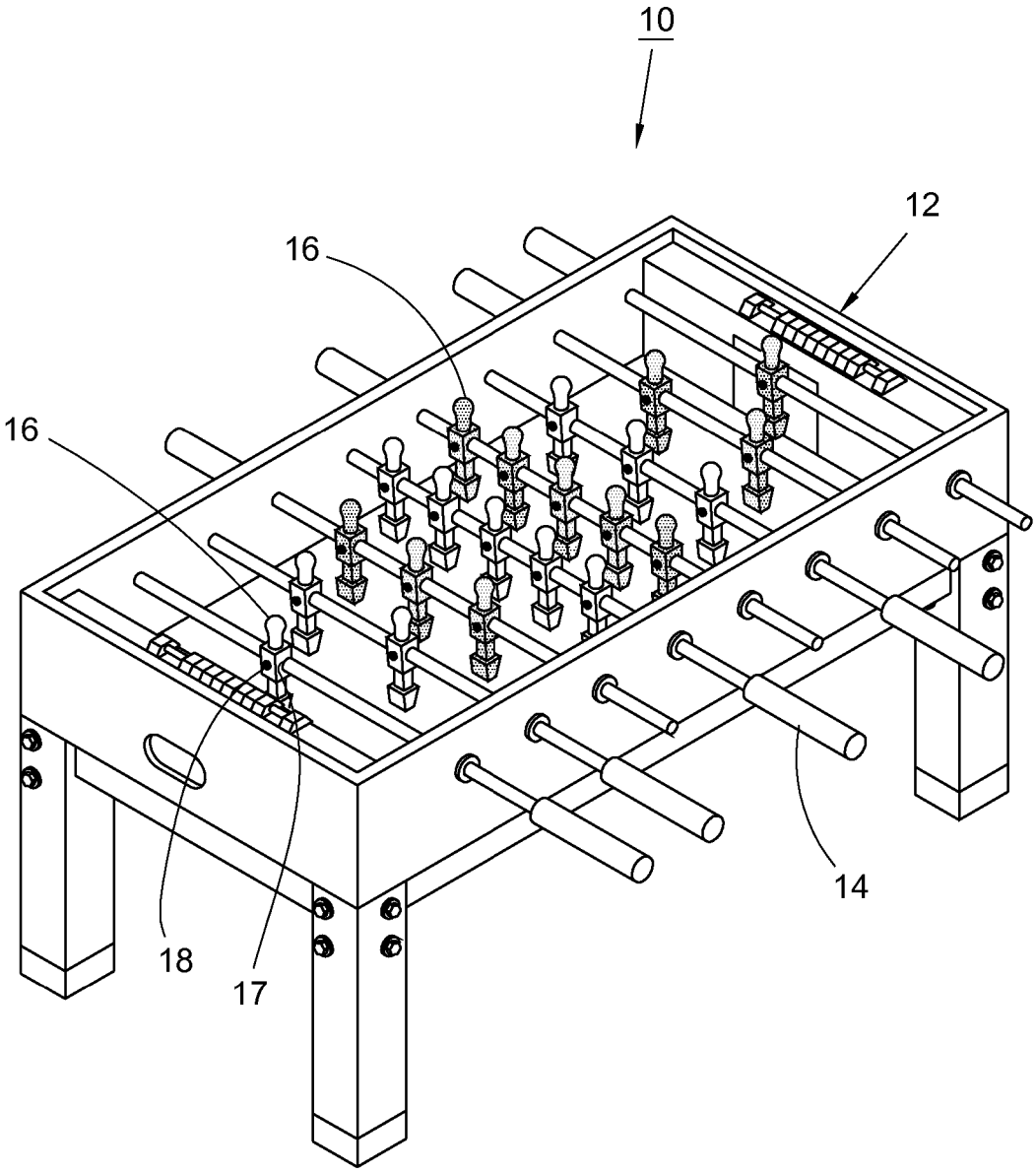
Fig. 1 PRIOR ART
FIG. 1 is a perspective view of a football game table having conventional dolls mounted on operation rods.
Figure 2:
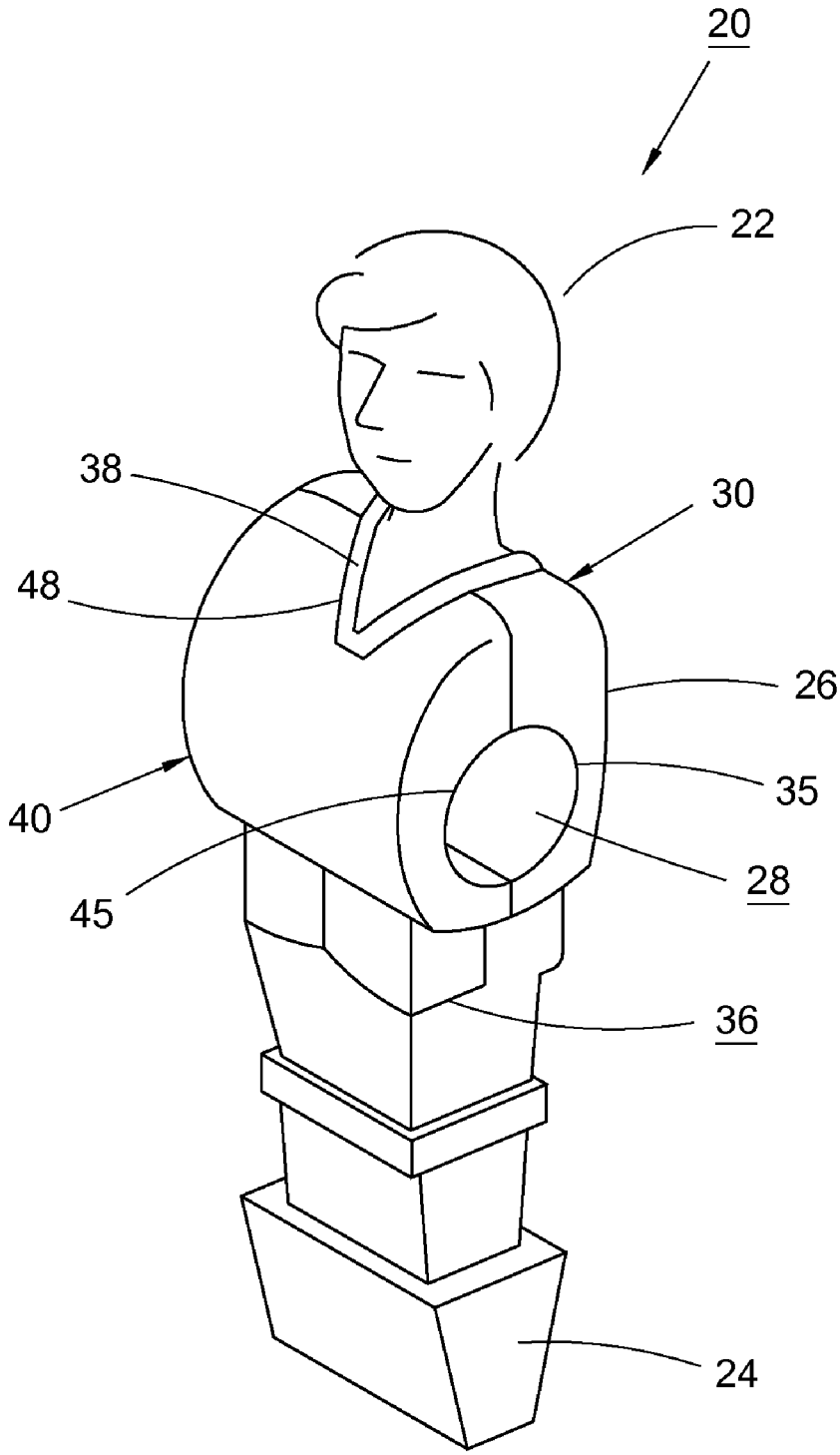
FIG. 2 is a perspective assembled view of a first embodiment of the doll of the present invention.
Figure 3:
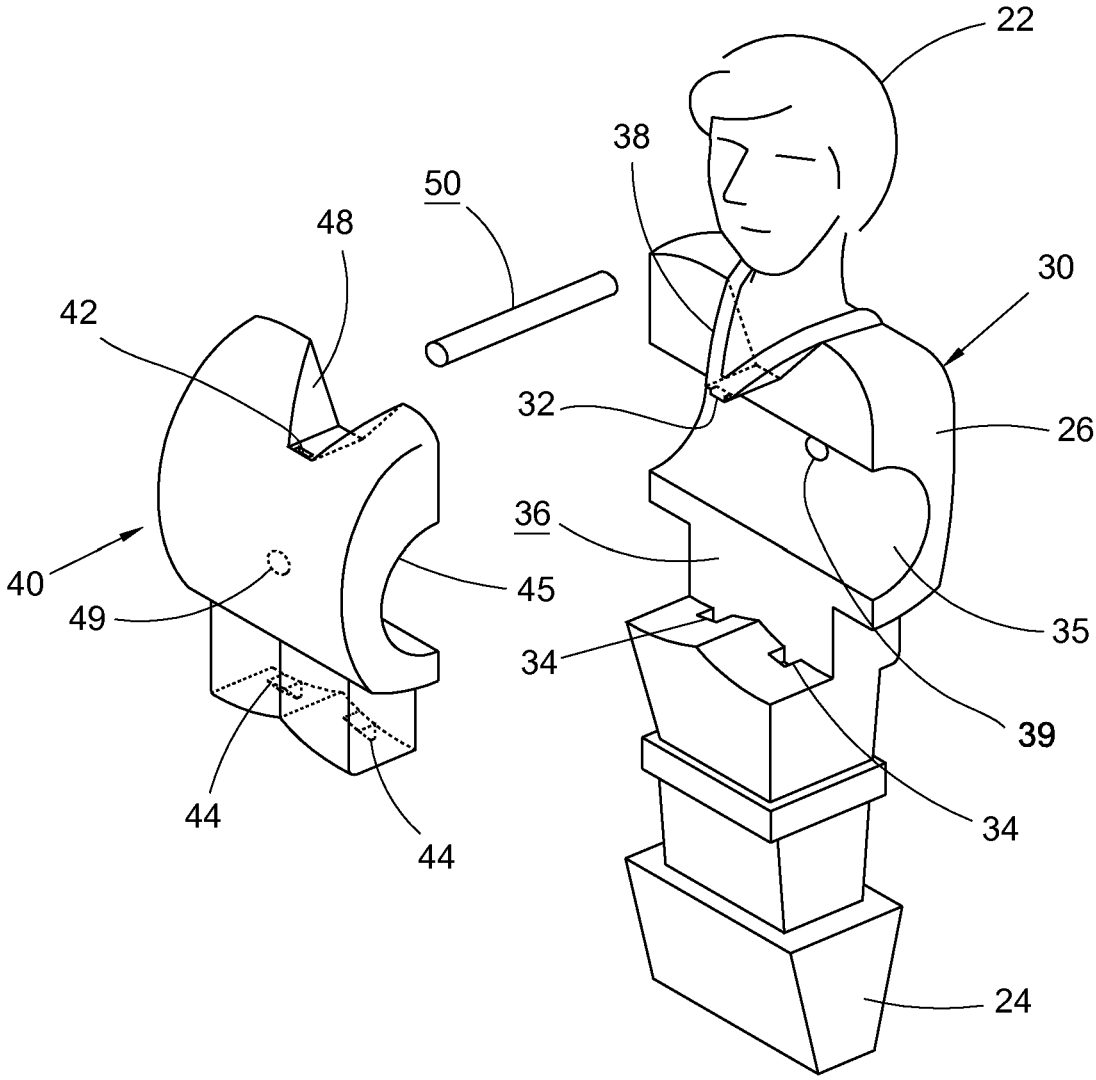
FIG. 3 is a perspective exploded view of FIG. 2.

Please refer to FIGS. 2 and 3. The first embodiment of the doll 20 of the present invention includes a first main body 30, a second main body 40 and at least one fixing member 50. In general, the doll 20 has a head portion 22, a leg portion 24 and a middle body portion 26 between the head portion and the leg portion. The two main bodies 30, 40 can be latched with each other to define a through hole 28 through an adjoining section of the main bodies. The through hole 28 passes through the doll from one side to the other side.

On a front face of the first main body 30 are formed an upper latched section 32, a lower latched section 34 and a first recess 35 between the upper and lower latched sections 32, 34.

The second main body 40 is formed with an upper latching section 42, a lower latching section 44 and a second recess 45. The second recess 45 is formed on a back face of the second main body 40 between the two latching sections 42, 44. The latching sections 42, 44 of the second main body 40 are respectively latched with the latched sections 32, 34 of the first main body 30 to mate the first and second main bodies 30, 40 with each other. The two recesses 35, 45 face each other to together form the through hole 28. Each of the recesses 35, 45 has a semicircular or polygonal cross-section, whereby the through hole 28 has a circular or polygonal (such as rectangular) cross-section.

Figure 4:
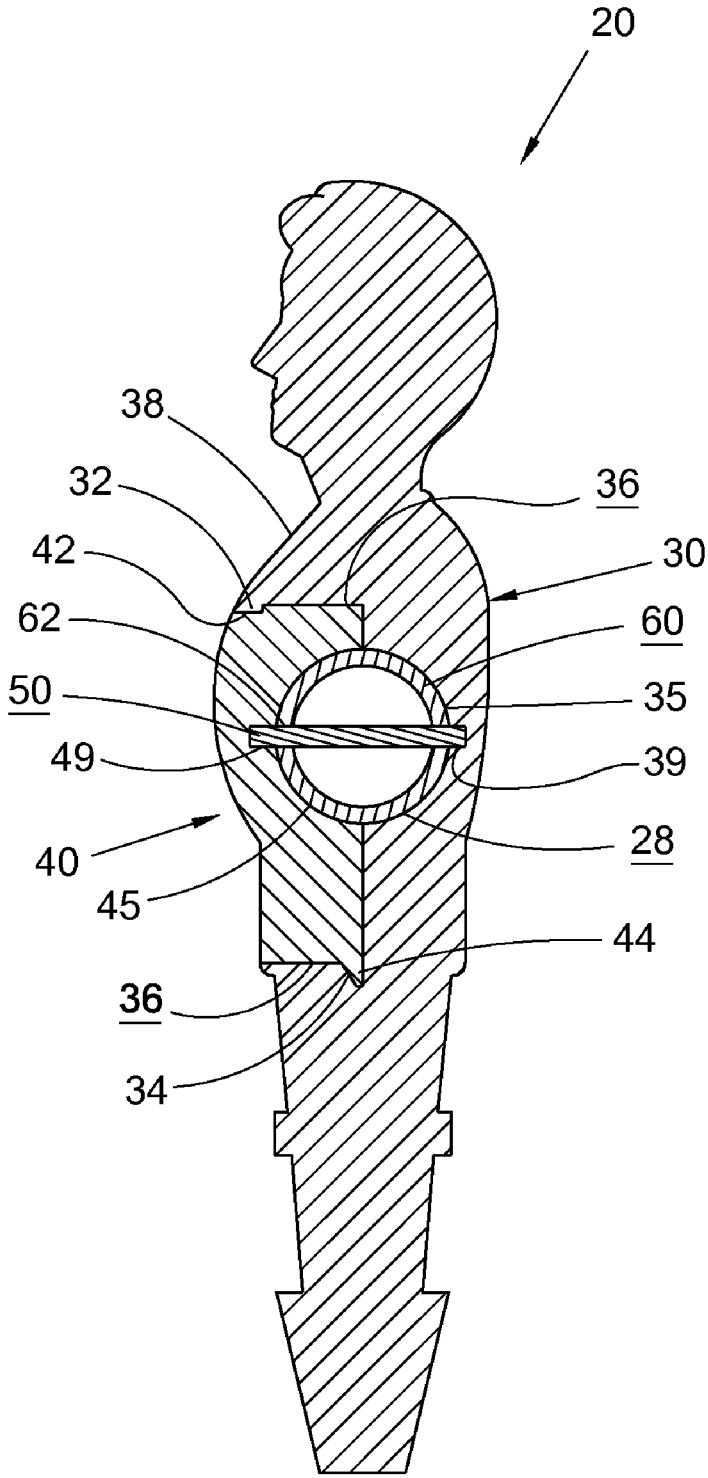
FIG. 4 is a sectional assembled view of the first embodiment of the doll of the present invention, in which the doll is mounted on an operation rod.

Referring to FIG. 4, the two main bodies 30, 40 are latched and mated with each other to hold an operation rod 60 which is positioned in the through hole 28. The fixing member 50 is positioned in the through hole 28 and inserted through the operation rod to engage at least one main body 30 or 40 with the operation rod 60.

To speak more detailedly, the first main body 30 has a top end, a bottom end and a middle portion. Preferably, the top end forms the head portion 22, the bottom end forms the leg portion 24, while the middle portion forms the body portion 26 of the doll. The front face of the middle portion of the first main body 30 is recessed to form a space 36. The upper and lower latched sections 32, 34 are respectively formed on the top wall and bottom wall of the space 36. An inner wall face of the space 36 is further recessed to form the first recess 35. The first recess 35 transversely passes through the first main body 30 from one side to the other side.

A triangular projection 38 is formed on the front face of the first main body 30 right above the space 36. A bottom face of the projection 38 serves as the top wall of the space 36. The projection 38 has a pattern as a collar of the doll. The upper latched section 32 is formed under the bottom face of the projection 38. In this embodiment, the lower latched section 34 is composed of two dents, however, this is not limited.

The second main body 40 has a height smaller than the height of the first main body 30 and has a size adapted to the size of the space 36. The lower latching section 44 is formed under the bottom face of the second main body 40. In this embodiment, the lower latching section is composed of two projecting insertion blocks, however, this is not limited. A triangular notch 48 is formed on the top end of the second main body. The upper latching section 42 is formed on the wall of the notch 48.

Preferably, the two main bodies 30, 40 are made by means of injection molding.

In this embodiment, the fixing member 50 is a pin. In practice, after main bodies are molded, one end of the pin 50 can be fixed with one of the main bodies 30, 40 in the recess 35 or 45. Alternatively, the pin 50 is not previously fixed with any main body. When assembled, the pin is fixed with the main bodies by way of insertion. In this case, the wall faces of the recesses 35, 45 are formed with insertion holes 39, 49 for inserting two ends of the pin therein.

The doll is mounted on an operation rod 60 which is drilled with several perforations 62.

Referring to FIG. 4, when installed the doll 20 on the operation rod, the recess 35 of the first main body 30 is first fitted on the operation rod 60. The pin 50 is passed through the perforation 62 with one end of the pin 50 inserted into the first recess 35 of the first main body. Then, the lower latching section 44 of the second main body 40 is latched with the lower latched section 34 of the first main body 30. Then the top end of the second main body is latched with the first main body to inlay the projection 38 in the notch 48. Under such circumstance, the upper latched section 32 is latched with the upper latching section 42 and the second main body 40 is accommodated in the space 36 of the first main body 30. After connected, the operation rod 60 is held in the two recesses 35, 45 and the pin 50 passes through the perforation 62 of the operation rod with two ends of the pin 50 respectively inserted in the insertion holes 39, 49 of the recesses 35, 45. The pin 50 is not exposed to outer side of the main bodies.

After assembled, the two main bodies of the doll are latched with each other to hold the operation rod. The projection 38 is inlaid in the notch 48 to more firmly associate the two main bodies. The fixing member 50 engages the two main bodies with the operation rod, whereby the doll 20 is firmly connected with the operation rod 60 without possibility of moving relative to the operation rod. Accordingly, when operating the operation rod, the doll is driven to move or rotate.

In case of damage of the doll, have the two main bodies unlatched from each other, whereby the doll can be taken off from the operation rod. Then a new doll can be mounted on the operation rod in the above manner instead of the damaged one. Accordingly, the doll can be easily replaced.

Figure 5:
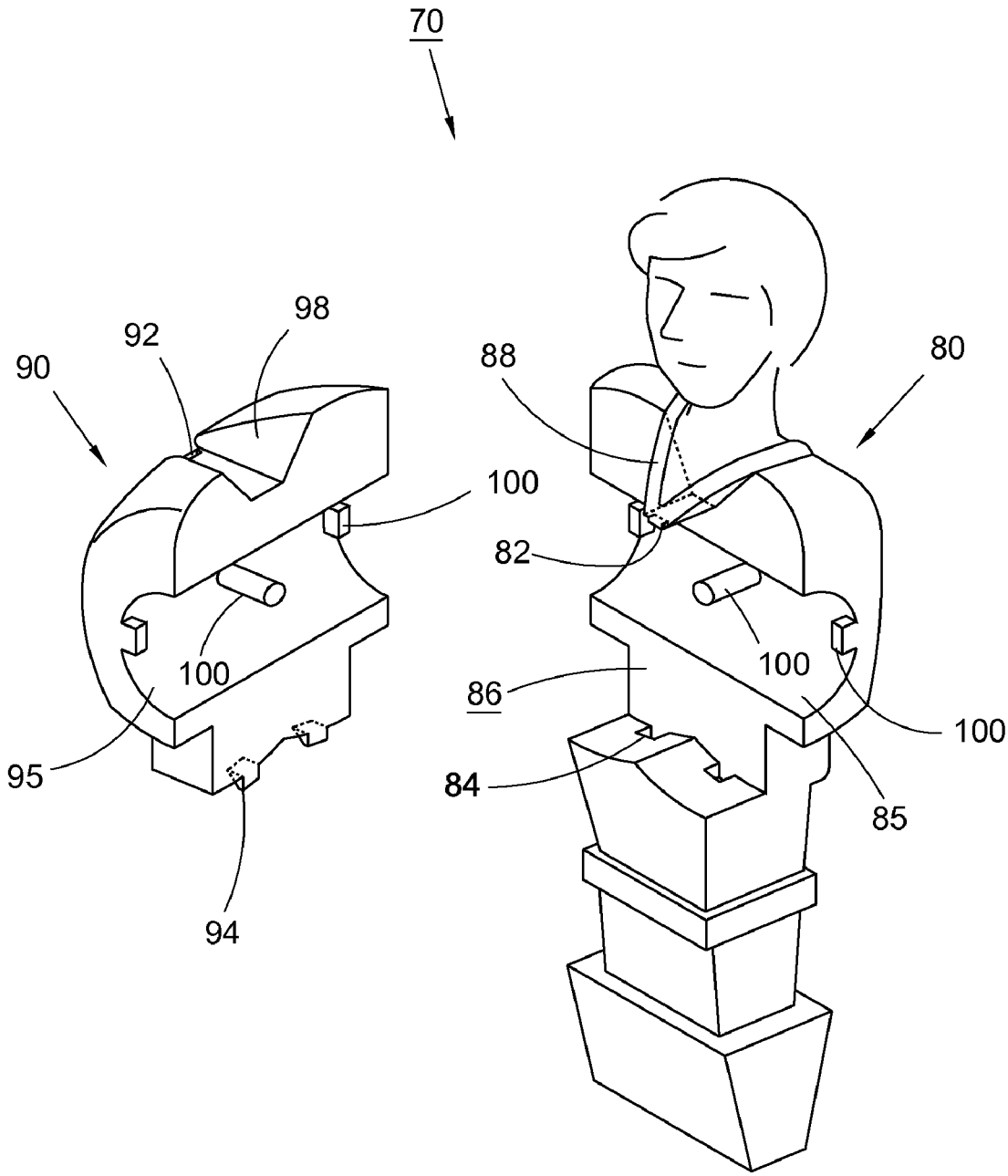
FIG. 5 is a perspective exploded view of a second embodiment of the doll of the present invention.
Figure 6:
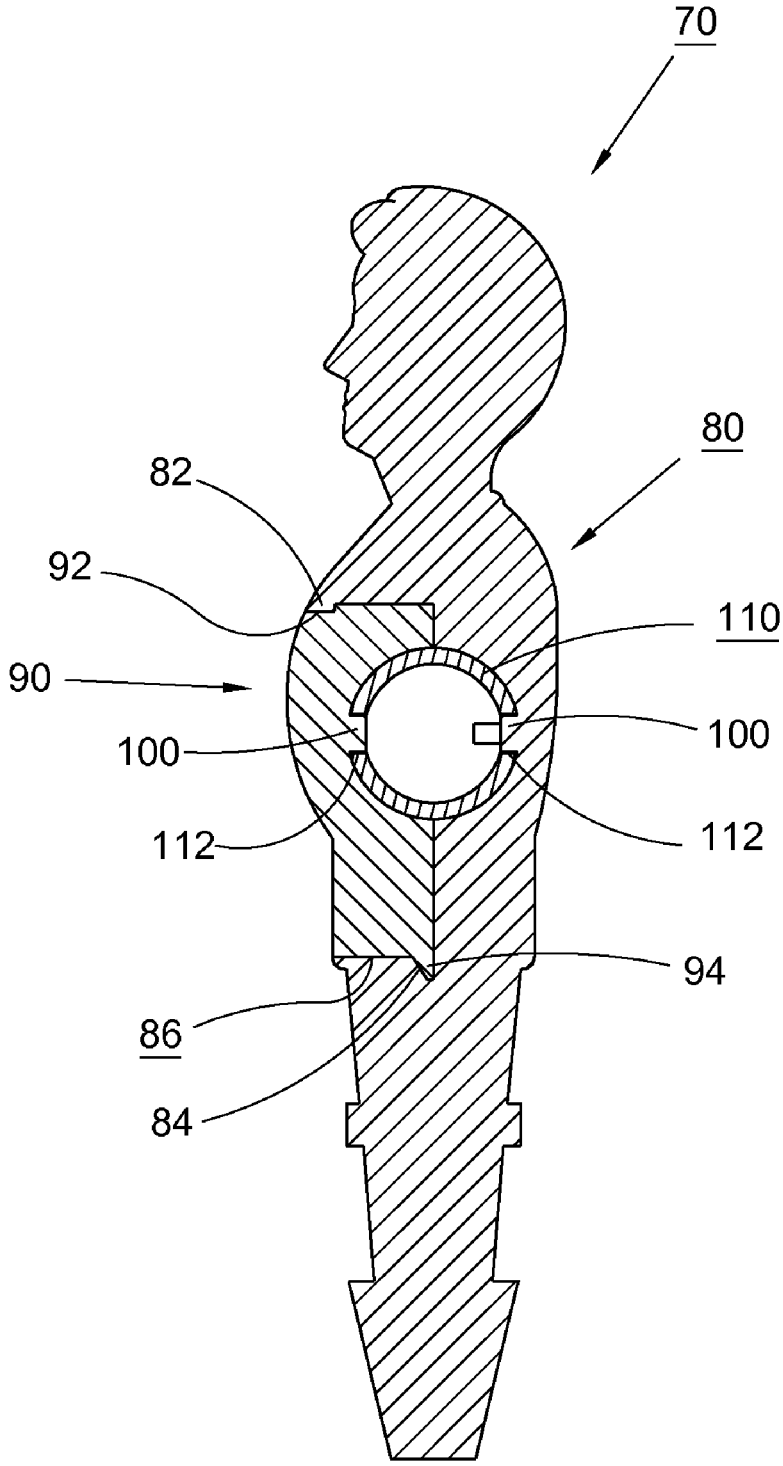
FIG. 6 is a sectional assembled view of the second embodiment of the doll of the present invention, in which the doll is mounted on an operation rod.

FIGS. 5 and 6 show a second embodiment of the doll 70 of the present invention, which includes a first main body 80, a second main body 90 and several fixing members 100. The upper and lower latched sections 82, 84 and the upper and lower latching sections 92, 94 of the main bodies 80, 90 and the recesses 85, 95, the space 86, the projection 88 and the notch 98 of the main bodies 80, 90 are identical to those of the first embodiment. Therefore, these parts will not be repeatedly described hereinafter.

In the second embodiment, at least one fixing member 100 is disposed on a wall face of at least one recess 85, 95. The fixing member 100 is a projecting section with a certain shape, for example, a column or a block. Preferably, the fixing member is integrally formed with the main body. The two main bodies 80, 90 are latched with each other in the same manner as the first embodiment. The doll 70 is fitted on an operation rod 110 with the fixing members 100 engaged in the dents or holes 112 of the operation rod. Accordingly, the two main bodies 80, 90 can be firmly associated with the operation rod.

The main bodies are detachably assembled so that the doll of the present invention is detachably mounted on the operation rod, which can be easily installed, disassembled and replaced. When replaced, it is unnecessary to troublesomely detach the operation rod from the football game table. In addition, in practice, the fixing member is hidden in the doll without being exposed to outer side so that the doll has a beautiful tidy appearance.

The above embodiments are only used to illustrate the present invention, not intended to limit the scope thereof. Many modifications of the above embodiments can be made without departing from the spirit of the present invention.

What is claimed is:

1. A doll of football game table for mounting on an operation rod of the football game table, comprising:

a first main body having an upper latched section, a lower latched section and a first recess, the first recess being formed on a front face of the first main body between the upper and lower latched sections, the first recess passing through the first main body from one side to another side;

a second main body having an upper latching section, a lower latching section and a second recess, the second recess being formed on a back face of the second main body between the upper and lower latching sections, the second recess passing through the second main body from one side to another side; the upper and lower latching sections of the second main body being respectively latched with the upper and lower latched sections of the first main body to detachably connect the first and second main bodies with each other; the two recesses facing each other to form together a through hole;

at least one fixing member positioned in the through hole and connected with at least one of said recesses, whereby the two main bodies are latched with each other to hold the operation rod; the fixing member serving to engage at least one of the two main bodies with the operation rod;

a middle portion of the front face of the first main body is recessed to form a space;

the upper and lower latched sections and the first recess being formed on the wall face of the space, when the two main bodies are latched with each other, the second main body being accommodated in the space;

a triangular projection is formed on the front face of the first main body right above the space, wherein the triangular projection is formed with two projection walls;

a triangular notch being formed on a top end of the second main body wherein the triangular notch is formed with two notch walls;

the two main bodies are latched with each other wherein the triangular projection is inlaid in the triangular notch, and the two projection walls and the two notch walls are attached to each other respectively;

a bottom face of the triangular projection serves as the top wall of the space;

the upper latched section being formed on the bottom face of the triangular projection;

the space having a bottom wall;

the lower latched section being formed on the bottom wall of the space;

the upper latching section being formed on a wall of the triangular notch; and the lower latching section being formed on the bottom end of the second main body.

2. The doll as claimed in claim 1, wherein the fixing member is a pin, at least one end of the pin being inserted in at least one of said recesses of the two main bodies.

3. The doll as claimed in claim 1, wherein a wall face of each recess is formed with an insertion hole, the fixing member being a pin, two ends of the pin being respectively inserted in the insertion holes.

4. The doll as claimed in claim 1, wherein the fixing member is a projecting section projecting from at least one of the recesses of the two main bodies.

* * * * *